United States Patent [19]

Updike et al.

[11] 4,425,882

[45] Jan. 17, 1984

[54] VALVE ROTATING DEVICE

[75] Inventors: Stanley H. Updike, Painesville; William A. Michaels, Seven Hills; Frederick L. Kuonen, Mentor, all of Ohio

[73] Assignee: TRW Inc., Cleveland, Ohio

[21] Appl. No.: 214,800

[22] Filed: Dec. 10, 1980

[51] Int. Cl.[3] ..... F01L 1/32

[52] U.S. Cl. ..... 123/90.3

[58] Field of Search ..... 123/90.28, 90.30, 90.29

[56] References Cited

U.S. PATENT DOCUMENTS

| | | | |
|---|---|---|---|
| 2,819,706 | 1/1958 | Gammon | 123/90.3 |
| 2,855,913 | 10/1958 | Geer | 123/90.3 |
| 3,421,734 | 1/1969 | Updike et al. | 251/337 |
| 3,537,325 | 11/1970 | Orent | 74/88 |
| 3,890,943 | 6/1975 | Schöwlau et al. | 123/90.3 |
| 4,094,280 | 6/1978 | Updike | 123/90.3 |
| 4,154,424 | 5/1979 | Cherrie | 123/90.3 |
| 4,227,493 | 10/1980 | Updike | 123/90.3 |

FOREIGN PATENT DOCUMENTS

| | | | |
|---|---|---|---|
| 2110708 | 9/1972 | Fed. Rep. of Germany | 123/90.3 |

*Primary Examiner*—Craig R. Feinberg
*Assistant Examiner*—W. R. Wolfe
*Attorney, Agent, or Firm*—Yount & Tarolli

[57] ABSTRACT

A valve rotator rotates a valve in an internal combustion engine about the axis of the stem of the valve. The valve is biased closed by a valve biasing spring. The valve rotator includes a body attached to and rotatable with the valve stem. The body has at least one groove therein extending at least partially around said valve stem. A coil spring element is longitudinally disposed within the groove. A collar receives the valve biasing spring force and encircles the valve stem adjacent the body. A pair of spring washers encircle said valve stem and are interposed between the collar and the coil spring element. One of the spring washers side loads the coils of said coil spring element when the valve is closed. The other of the spring washers acts between the collar and the one spring washer and isolates surges of the valve spring of a predetermined magnitude from the one spring washer and thereby from the coils of the coil spring element.

7 Claims, 10 Drawing Figures

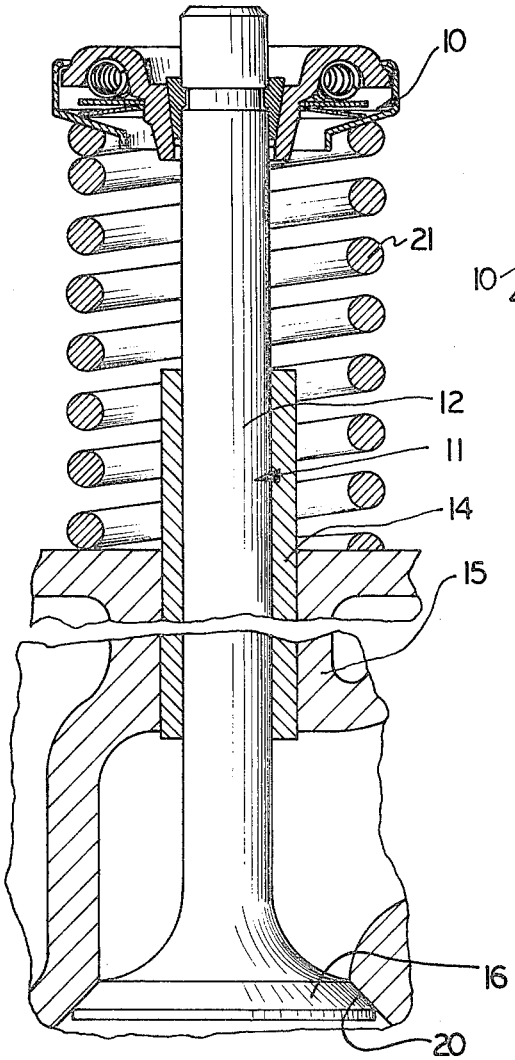
FIG. 1
FIG. 2
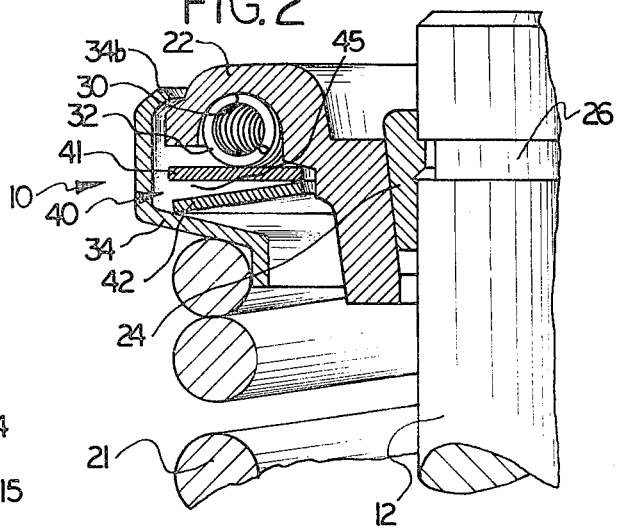
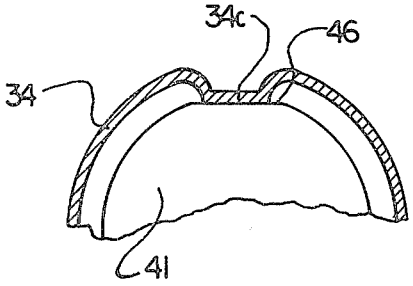
FIG. 6
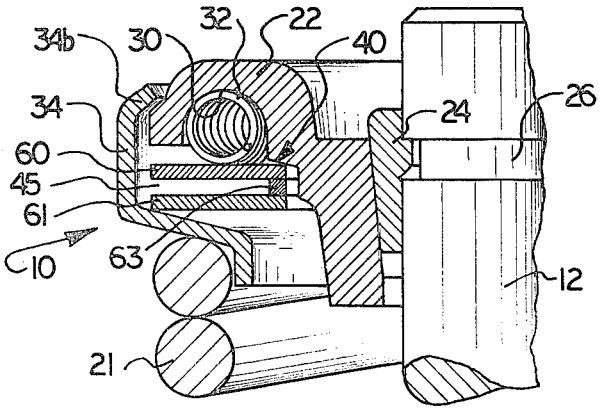
FIG. 7

VALVE ROTATING DEVICE

BACKGROUND AND SUMMARY OF THE INVENTION

The present invention relates to a valve rotator for rotating a valve of an internal combustion engine. The invention specifically relates to a type of valve rotator which uses a garter spring to rotate the valve.

Valve rotators which use a garter spring for rotating a valve of an internal combustion engine are known. U.S. Pat. Nos. 4,094,280; 3,537,325; 3,421,734 and 2,819,706 are examples of such rotators. A typical embodiment of a valve rotator using a garter spring includes a body attached to the valve. The body has an annular channel and a garter spring is longitudinally disposed within the annular channel. A spring washer acts between a collar and the body. The valve spring acts on the collar. When the valve is in a closed position, the coils of the garter spring are normally tilted relative to the axis of the garter spring due to side loading by the spring washer.

The principle of operation of the known garter spring valve rotators is simple. The spring washer acts against the valve rotator body and the frictional force therebetween resists rotation of the rotator body. As the valve opens, the valve spring is compressed between the collar and the cylinder head. The valve spring force is transmitted by the collar to one portion of the spring washer. The force the collar exerts on the spring washer causes the spring washer to deflect over the garter spring, increasing garter spring loading. The force of the valve spring is transmitted to the valve rotator body through the spring washer and the garter spring. As the side load on the coils of the garter spring increases, each coil of the garter spring will tilt further from its normal position. This action overcomes the frictional resistance between the spring washer and the body. Accordingly, the body and the valve rotate as the garter spring coils tilt, and the valve rotator body slides on the spring washer. As the valve closes, the spring washer restores itself to its valve-closed position, and the garter spring coils also restore themselves to their normal tilted position in preparation for another cycle.

In such rotators, the garter spring is subjected to oscillating loads and resonant frequencies induced by valve spring surges. Valve spring surges can cause garter spring failure in two ways. First, valve spring surge, while the valve is on its seat, can cause an unloading of the spring washer which engages the garter spring. This unloading can allow the garter spring coils to erect themselves. Specifically, the individual garter spring coils may lose their tilt or may tilt in different directions. When the spring washer subsequently loads the garter spring, the individual coils of the garter spring may be tilted in opposite directions. Second, longitudinal vibrations of the garter spring coils can be generated by valve spring surge. The longitudinal vibrations can cause relative movement of coils of the garter spring. Specifically, an end coil of the garter spring could move away from the other coils due to longitudinal vibrations. In fact, end coils have been known to move so far away from other coils that the end coils reverse or invert and subsequently break.

One solution is dislosed in U.S. Pat. No. 4,094,280. This patent discloses the use of a material which is placed in contact with the garter spring to dampen vibration of the garter spring. Another suggestion is to have a specially made garter spring whose coils are tilted in a free state as shown in U.S. Pat. No. 3,468,527. However, such has been difficult to manufacture.

The present invention is a totally new approach to solving the problems created by valve spring surge. The present invention minimizes the problem by isolating the garter spring from valve spring surges. In particular, the garter spring is isolated from surges which unload the valve spring and thus could unload the garter spring coils and create the aforementioned problems. Briefly stated, the invention consists of the inclusion of a specially constructed spring arrangement placed between the garter spring and the valve spring. The purpose and effect of the spring arrangement is to (i) isolate the garter spring from valve spring surges which would tend to excessively unload the garter spring and (ii) transmit the valve spring force to the garter spring when valve rotation is desired.

In accordance with the present invention, dual spring washers are located between the garter spring and the valve spring. One spring washer engages the garter spring. The other spring washer engages the first spring washer adjacent its inner periphery. The other spring washer at its outer periphery engages the collar against which the valve spring acts.

In one embodiment of the invention, when the valve is closed, the two spring washers are spaced apart at their outer periphery. Valve spring unloading results in unloading of the spring washer in engagement with the collar. Such unloading is not transmitted to the spring washer which engages the garter spring because of the space between the outer periphery of the two spring washers. However, when the valve spring force is increased, due to valve opening, the outer peripheries of the two spring washers move into contact, and force is transmitted to the garter spring coils to effect tilting thereof and rotation of the valve through both spring washers.

In accordance with another embodiment of the present invention, the outer peripheries of the dual spring washers may be in engagement when the valve is closed. In this embodiment, unloading of the valve spring a slight amount is not sufficient to result in disengagement of the spring washers. Thus, slight unloading of the valve spring is transmitted to the garter spring coils and thus reduces the side loading of the coils of the garter spring. However, excessive valve spring unloading causes the spring washers to separate at their outer peripheries before an excessive reduction in the side loading of the garter spring coils. Thus, excessive unloading of the garter spring coils does not occur.

In accordance with the present invention, the spring washers may be of a variety of different constructions. For example, one spring washer may be a conical washer, and the other may be a flat spring washer. Alternatively, both spring washers may be flat spring washers with a spacer between the inner peripheries thereof. Further, instead of a spacer between two flat spring washers, one of the washers may be provided with a lip which forms a spacer.

Further, the spring washers in the present invention may have a tendency to rotate about their own axes. Accordingly, the construction is made so that the spring washers are prevented from rotating about their own axes. This can be accomplished in a variety of ways, but preferably the spring washers are provided with flats which are engaged by a portion of the collar which encircles the spring washers to prevent rotation thereof.

BRIEF DESCRIPTION OF THE DRAWINGS

Further features and advantages of the present invention will be apparent to those skilled in the art to which the invention pertains from the following detailed description of embodiments of the invention made with reference to the annexed drawings wherein:

FIG. 1 is a sectional view of a valve assembly of an internal combustion engine embodying a valve rotator of the present invention;

FIG. 2 is a fragmentary sectional view of the valve rotator of FIG. 1 on an enlarged scale;

FIG. 6 is a fragmentary sectional view of the rotator of FIG. 2 illustrating a structural feature thereof; and FIGS. 7–10 are fragmentary sectional views of further embodiments of the present invention.

DESCRIPTION OF PREFERRED EMBODIMENTS

Figure 3:
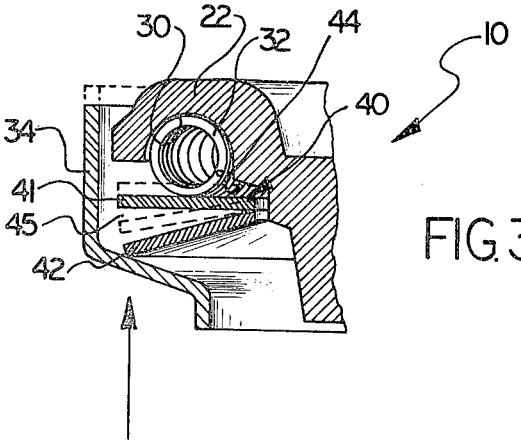
FIG. 3 is a view of the parts of a valve rotator of the present invention in a partially assembled condition.

As noted hereinabove, the present invention relates to a valve rotator for rotating a valve in an internal combustion engine. The valve rotator is of the garter spring type and is constructed so that valve spring surges do not adversely affect the garter spring. The specific structure of the rotator may vary, as may the engine environment in which it is used. As representative of one embodiment of the present invention, a valve rotator 10 is illustrated in the drawings.

The valve rotator 10 is associated with a valve 11. The valve 11 includes a valve stem 12 slidably received in a valve guide 14 mounted in the engine block 15. At the lower end of the valve stem 12 is a valve head 16. On the valve head 16 is the valve face which sealingly engages a valve seat 20 on the engine block. The valve head 16 is biased into engagement with the valve seat 20 by a valve spring 21 which acts between the cylinder block 15 and the valve stem 12. Specifically, the valve spring 21 acts at its upper end against the valve rotator 10 to bias the valve 11 closed.

The valve rotator 10 includes a body 22 nonrotatably attached to the valve stem 12 by a keeper or keepers 24. The keepers 24 engage in a groove 26 in the valve stem 12 and are fixed to the valve stem. The keepers 24 are also held in the body 22 by a friction fit and fix the body to the valve stem 12. The details of this construction will not be described since the construction is conventional and does not form a part of the invention. It should be apparent that rotation of the body 22 will effect rotation of the valve stem 12.

The body 22 has a circumferential annular groove 30 (see FIG. 2) therein which extends around the axis of the valve stem 12. A garter spring 32 is longitudinally disposed within the annular groove 30. Specifically, the garter spring is a coil spring and its axis a (see FIG. 4) lies generally parallel to the annular groove 30.

The valve rotator 10 also includes a collar 34 or valve spring retainer against which the valve spring 21 acts. Interposed between the collar 34 and the garter spring 32 is a spring washer arrangement, generally designated 40. The spring arrangement 40 includes a pair of spring washers 41, 42. In the embodiment of FIGS. 1–6, the spring washer 41 is a flat washer and the spring washer 42 is a conical washer and has a conical configuration as is known and illustrated in the drawings.

The spring arrangement 40 side loads the garter spring coils, when the valve 11 is closed. The coils of the garter spring are side loaded by the spring arrangement 40 such that they are "tilted". This tilt is best shown in FIG. 4 which schematically and in exaggerated fashion illustrates the position of the parts when the valve head 16 is engaged with the valve seat 20.

Figure 4:
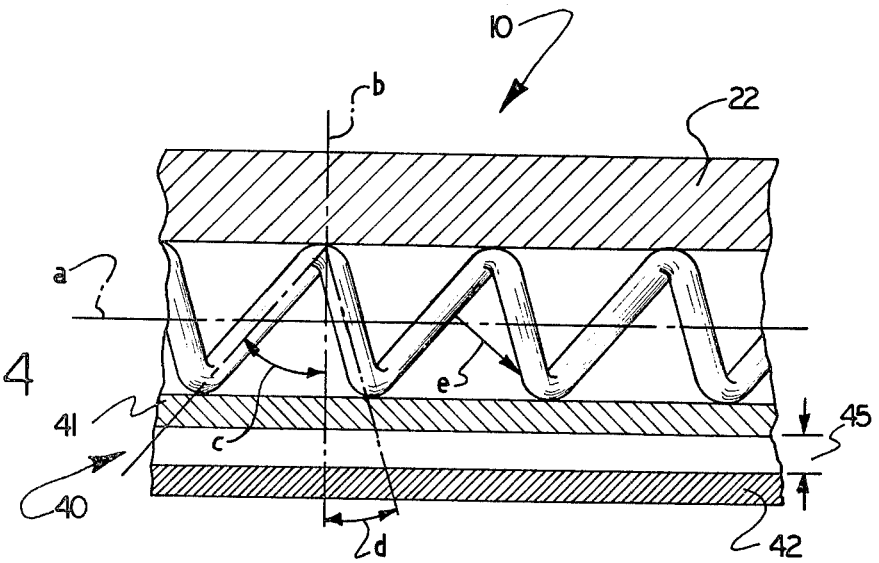
FIG. 4 is a schematic view illustrating the parts of the valve rotator of FIG. 1 in an exaggerated manner.
Figure 5:
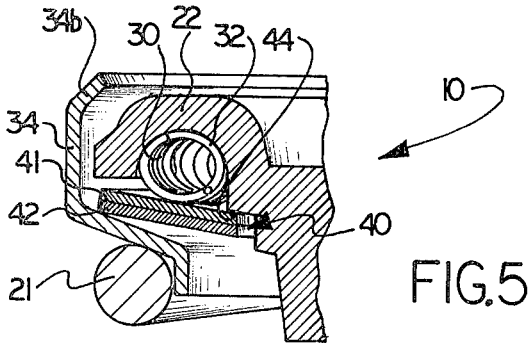
FIG. 5 is a fragmentary sectional view of the valve rotator of FIG. 2 but showing the parts in a different operative position.

As shown in FIG. 4, the axis of the garter spring is designated a. A line perpendicular to the axis a and which extends through the point of contact of a garter spring coil with the body 22 is designated b. The vertical angle formed between the vertical b and a coil as the coil extends in one direction from the line b is designated c. The vertical angle between the vertical b and the coil as it extends in the opposite direction from the line b is designated d. It should be clear that the angle c is greater than the angle d for each coil of the garter spring. As a result, the garter spring is termed "tilted". Of course, as the body 22 moves toward the spring washer arrangement 40, the coils of the garter spring will tend to collapse in the direction of the arrow e because of the aforementioned tilt of the coils of the garter spring 32. FIG. 4 is exaggerated in a number of respects. The coils are spaced too far apart and the lengths of different halves of a coil are different. Obviously, such does occur in the actual construction.

During assembly of the valve rotator, the parts of the valve rotator are positioned generally as illustrated in FIG. 3. As shown in FIG. 3, the garter spring coils will be erect (i.e., the angles c and d will be equal) and act against the spring washer 41 to position the spring washer 41 in a position out of engagement with the body 22. The spring washer 42 and the collar 34 will be located as shown.

A force is then applied to the assemblage of parts shown in FIG. 3 to move the parts together. This force first causes the inner circumference or periphery of spring 41 to move into engagement with a shoulder 44 of the body 22. Thus, the garter spring coils are tilted, and the spring washer 41 is loaded thereby. Specifically, the spring washer 41 resists the tendency of the coils to be erect. After the garter spring coils are tilted, the assembly force is continued to be applied which compresses or loads the spring washer 42. No further loading of the spring washer 41 or garter spring coils occurs because the spring washer 41 is bottomed on the shoulder 44. Thereafter, the portion **34*b* of the collar 34 is spun over the body 22 to hold the parts in the assembled position. When so assembled, the garter spring coils are loaded and the washers 41, 42** are loaded.

When the rotator is assembled in an engine, the valve spring 21 acts on the collar 34 forcing the spun over portion **34*b* of the collar 34 away from the body 22. The valve spring force thereby causes the spring washer 42 to be loaded further, which load is transmitted through the inner periphery of spring 41 to the shoulder 44 of the body 22. Thus, the spring 41 is not loaded thereby. Therefore, it should be clear that the spring washer 42 is loaded to a greater extent than spring washer 41** when the rotator is assembled in the engine.

As shown in the drawings, the spring washer 41 contacts the coils of the garter spring 32 intermediate its inner and outer circumferences. The second spring washer 42 contacts the spring washer 41 adjacent its inner circumference. The outer circumference of the spring washer 42 engages the collar 34. The outer circumference of the spring washer 42 is spaced axially from the outer circumference of the spring washer 41 when the valve is in its closed position. The space between the outer circumferences of the spring washers is designated 45.

The manner in which the valve 11 is rotated by the rotator 10 should be apparent to one skilled in the art. The body 22 moves downward on opening of the valve 11. The downward movement of the body 22 compresses the valve spring 21. Compression of the valve spring 21 increases the force that the valve spring exerts on the collar 34. This force is, in turn, transmitted to the spring washer 42. As the force increases, the outer circumference of the spring washer 42 will move toward the spring washer 41. Eventually the outer circumferences of spring washers 41, 42 will engage each other, and the garter spring loading will be increased. Thus, as the force continues to increase, the coils of the garter spring 32 will be forced to tilt further. The body will rotate, since the force applied thereto by the garter spring coils will be sufficient to overcome the friction force between the inner periphery of the spring washer 41 and the body 22. The body 22 will thus slide on the washer 41 as it rotates.

From the above, it should be apparent that the valve 11 will rotate upon opening thereof. When the valve 11 moves from an open position to a closed position, the parts cooperate in such a manner that the frictional force between the inner periphery of the spring washer 41 and the shoulder 44 of the body 22 is sufficiently great to prevent the body 22 from rotating back to its initial position. Reverse rotation of the valve is thus braked or prevented by the washer 41. This is known and discussed in U.S. Pat. No. 3,537,325 for example. The rotator 10 thus acts to provide net rotation in one direction to the valve 12.

Heretofore, valve rotators were subject to problems if the garter spring lost its side loading. Specifically, in prior art valve rotators, the side load on the garter spring could be lessened, and, in fact, the garter spring could become completely unloaded. This would occur because the valve spring force acting to side load the garter spring would lessen due to valve spring surges. For example, if the valve spring force reduced with the valve closed, the garter spring coils could unload and the coils could become erect. Subsequent loading of the garter spring coils could cause the garter spring coils to tilt in opposite directions.

The present invention is not subject to the above-noted problems. Specifically, unloading of the garter spring coils in the present invention cannot occur as in the prior art. It should be apparent that if the valve spring load is lessened in the present construction, the garter spring coils would not become unloaded. Specifically, if the valve spring 21 unloads due to a valve spring surge, the outer periphery of the spring washer 42 would follow the movement of the valve spring. The inner periphery of the spring washer 42 would remain in contact with the spring washer 41 holding the spring washer against the shoulder 44. This would maintain the garter spring coils loaded, and the reduction in force would not be transmitted to the spring washer 41. Thus, the spring washer 42 comprises a means for isolating those surges from the spring washer 41.

During operation of the valve rotator embodying the present invention, the spring washers 41, 42 may have a tendency to rotate. A suitable arrangement is preferably provided to prevent such rotation. Any suitable arrangement may be used. As illustrated in the drawings, each of the washers is provided with diametrically opposite flats. Only one flat 46 for the washer 41 is shown in FIG. 6. The flat is engaged by a deformed or dimpled portion **34*c* of the collar 34. Accordingly, neither washer 41 nor 42 can rotate about its own axis. The portion 34*c*, of course, does not affect the action of the spring washers 41, 42** otherwise since sufficient clearance is provided to enable the spring washers to properly deflect.

FIGS. 7–10 illustrate further embodiments of the present invention. FIGS. 7–10 are constructed similarly to the embodiment of FIG. 1, and the same reference numerals used to designate parts of the embodiment of FIG. 1 are used to designate corresponding parts of the embodiments of FIGS. 7–10. The embodiments of FIGS. 7–10 all include a spring washer arrangement 40 which differs structurally from the spring washer arrangement 40 disclosed in the embodiment of FIGS. 1–6, but which functions in the same or a similar manner. Specifically, in the embodiments of FIGS. 7–10, the spring washer arrangement 40 functions to prevent excessive valve spring surges from unloading the garter spring coils but yet transmits force to the garter spring coils to effect rotation of the valve.

FIG. 7 illustrates an embodiment of the present invention which uses two flat washes 60, 61. The washers 60, 61 are separated by a spacer ring 63 located at the inner circumferences of the washers. Instead of the spring washers 60, 61 contacting each other over their facing areas, as in the embodiment of FIG. 1, during valve opening, the washers 60, 61 engage along their outer circumferences. It has been found that the shape of the spacer 63 is not important to the operation of the invention. The important factor is that the space 45 between the two washers 60, 61 be maintained.

Figure 8:
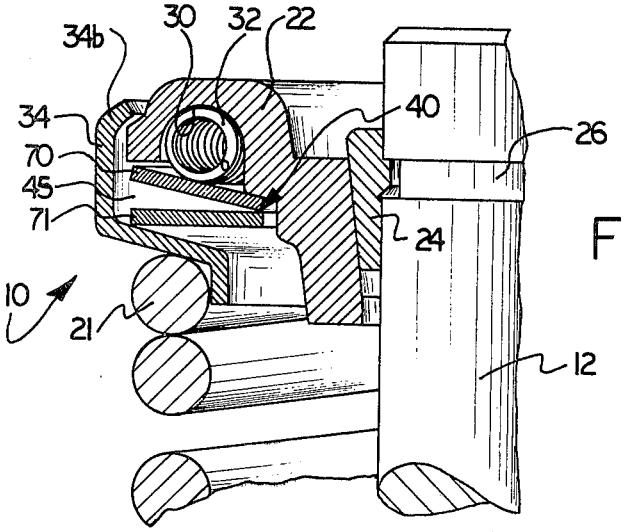

The embodiment of FIG. 8 is identical to the embodiment of FIGS. 1–6, except rather than the conical washer engaging the collar 34, as in the embodiment of FIGS. 1–6, a conical washer 70 engages the garter spring 32. A flat washer 71 engages the collar 34. The flat washer 71 and the conical spring washer 70 engage near the inner circumferences thereof.

Figure 9:
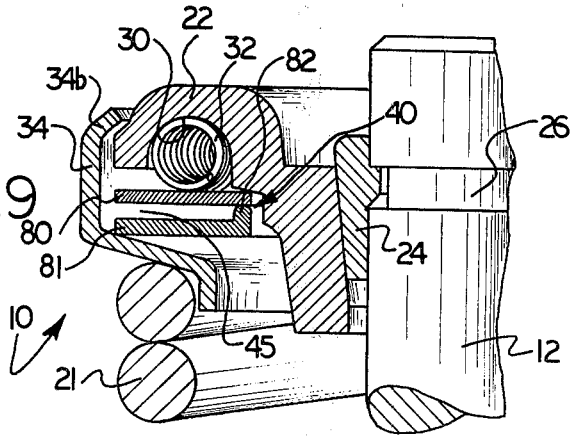

A further embodiment of the present invention is shown in FIG. 9. In this embodiment, the washer arrangement 40 comprises a flat washer 80 and a formed washer 81. The flat washer 80 engages the garter spring 32. The formed washer 81 has a lip 82 around the inner circumference thereof. The purpose of the lip 82 is to serve as a spacer to separate the flat washer 80 and the formed washer 81. This construction has the advantage of simplifying assembly while minimizing wear surfaces between the washers as compared with the design of FIG. 7.

Figure 10:
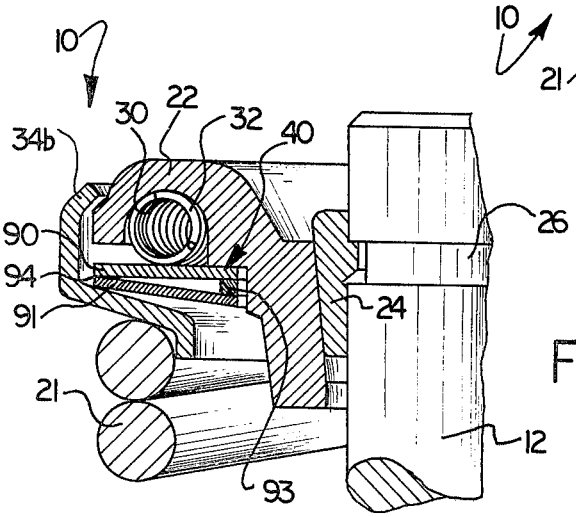

A still further embodiment of the present invention is illustrated in FIG. 10. In the embodiment of FIG. 10, the spring washer arrangement 40 includes two spring washers 90, 91 interposed between the collar 34 and the garter spring 32. These spring washers are spaced apart at their inner circumference by a spacer 93. The lower spring washer 91, as shown in the drawings, engages the collar 34 and the upper spring washer 90 side loads the coils of the garter spring 32.

When the valve rotator of FIG. 10 is assembled, the outer circumferences of the spring washers are spaced apart. When the valve rotator is placed in an engine, the valve spring force causes the outer periphery of washer 91 to move into engagement with and load the outer periphery of the washer 90. The washers will thus carry a different load. For example, the washer 91 may carry 75% of the valve closed spring load and the washers 91 and 90 share the remaining 25% of the valve closed spring load.

A certain degree of initial unloading of the valve spring affects both spring washers 90, 91. This degree of unloading also results in some reduction in garter spring side loading. However, in the event of excessive valve spring surge, which causes an excessive unloading of the valve spring, the lower spring 91 will move away from the upper spring 90, and thus excessive unloading is not transmitted to the garter spring coils. As in the other embodiments, the garter spring coils cannot erect themselves, due to valve spring surges which tend to excessively unload the valve spring.

All of the above embodiments relate to valve rotators located at the tip end of the valve stem. It should be apparent that the invention is equally applicable to valve rotators located at the guide end of the valve stem.

What is claimed is:

1. In an internal combustion engine, a valve reciprocable between an open position and a closed position, a valve seat in a cylinder head, a valve spring, said valve having a valve body for seating against said valve seat in the valve closed position and a longitudinal valve stem, said valve spring acting to bias said valve to a valve closed position, and a valve rotator for rotating said valve about the axis of said valve stem during a valve opening stroke, said valve rotator comprising:

(a) a body to be attached to and rotatable with the valve stem, said body having at least one groove therein extending at least partially around said valve stem;

(b) at least one coil spring element longitudinally disposed within said groove;

(c) a collar for receiving the valve spring biasing force and encircling said valve stem adjacent said body, said body and said collar being movable in axial and rotational directions relative to each other;

(d) a pair of spring washers encircling said valve stem and interposed between said collar and said coil spring element;

(1) one of said spring washers side loading the coils of said coil spring element when the valve is closed and having a portion bearing on said body when the valve is closed, (2) the other of said spring washers acting between said collar and said portion of said one spring washer and having a first portion which overlies said portion of said one spring washer bearing on said body when the valve is closed and a second portion spaced from said one spring washer when the valve is closed, (3) each of said spring washers having an inner circumference and an outer circumference, said overlying portions of said one and said other spring washers cooperating with each other adjacent the inner circumferences thereof to transmit surges of the valve spring from said collar through said overlying portions of said one and said other spring washers to said body to thereby isolate surges of the valve spring from the coils of said coil spring element, said second portion of said other spring washer engaging said one spring washer adjacent their outer circumference when the valve spring biasing force exceeds a predetermined amount to transmit the valve spring biasing force to said coil spring element to thereby effect rotation of said body and the valve stem.

2. A valve rotator for rotating a valve in an internal combustion engine, the valve having a valve stem with a longitudinal axis and being rotatable about its longitudinal axis during a valve opening stroke, the valve being biased closed by a valve spring, said valve rotator comprising:

(a) a body to be attached to and rotatable with the valve stem, said body having at least one groove therein extending at least partially around said valve stem;

(b) at least one coil spring element longitudinally disposed within said groove;

(c) a collar for receiving the valve spring biasing force and encircling said valve stem adjacent said body, said body and said collar being movable in axial and rotational directions relative to each other;

(d) a pair of spring washers encircling said valve stem and interposed between said collar and said coil spring element, (1) one of said spring washers side loading the coils of said coil spring element when the valve is closed and having a portion bearing on said body when the valve is closed, (2) the other of said spring washers acting between said collar and said portion of said one spring washer and having a first portion which overlies said portion of said one spring washer bearing on said body when the valve is closed and a second portion spaced from said one spring washer when the valve is closed, (3) each of said spring washers having an inner circumference and an outer circumference, said overlying portions of said one and said other spring washers cooperating with each other adjacent the inner circumferences thereof to transmit surges of the valve spring from said collar through said overlying portions of said one and said other spring washers to said body to thereby isolate surges of the valve spring from the coils of said coil spring element, said second portion of said other spring washer engaging said one spring washer adjacent their outer circumference when the valve spring biasing force exceeds a predetermined amount to transmit the valve spring biasing force to said coil spring element to thereby effect rotation of said body and the valve stem.

3. A valve rotator as defined in claim 2 wherein said one spring washer comprises a flat washer and the other comprises a conical washer.

4. A valve rotator as defined in claim 2 wherein each of said spring washers comprises a flat washer, and further including a spacer interposed between said spring washers adjacent the inner circumferences thereof.

5. A valve rotator as defined in claim 2 wherein said one spring washer comprises a conical washer and the other comprises a flat spring washer.

6. A valve rotator as defined in claim 2 wherein said one spring washer comprises a flat spring washer and said other spring washer comprises a flat washer with an integral lip adjacent its inner circumference comprising a spacer between said spring washers.

7. A valve rotator as defined in claim 2 further including means for preventing rotation of said spring washers relative to each other and said collar.

* * * * *